United States Patent [19]

LaBorde, Jr.

[11] 4,166,335

[45] Sep. 4, 1979

[54] LARGE MODEL BOAT ASSEMBLY

[76] Inventor: Bennett P. LaBorde, Jr., P.O. Box 552, Scott, La. 70583

[21] Appl. No.: 855,061

[22] Filed: Dec. 13, 1977

[51] Int. Cl.[2] ..... A63H 23/02

[52] U.S. Cl. ..... 46/1 R; 46/17; 46/93

[58] Field of Search ..... 46/1 R, 17, 93; 9/6 R, 9/6 B; 114/261, 262

[56] References Cited

U.S. PATENT DOCUMENTS

| | | | |
|---|---|---|---|
| 1,259,572 | 3/1918 | Wilcox | 46/93 |
| 4,044,414 | 8/1977 | Grycel | 46/1 R |

*Primary Examiner*—Louis G. Mancene
*Assistant Examiner*—Robert F. Cutting
*Attorney, Agent, or Firm*—Roy, Kiesel, Patterson & Abadie

[57] ABSTRACT

A model boat assembly is provided for constructing large model boats, particularly warship designs, from principally cardboard and like material.

1 Claim, 1 Drawing Figure

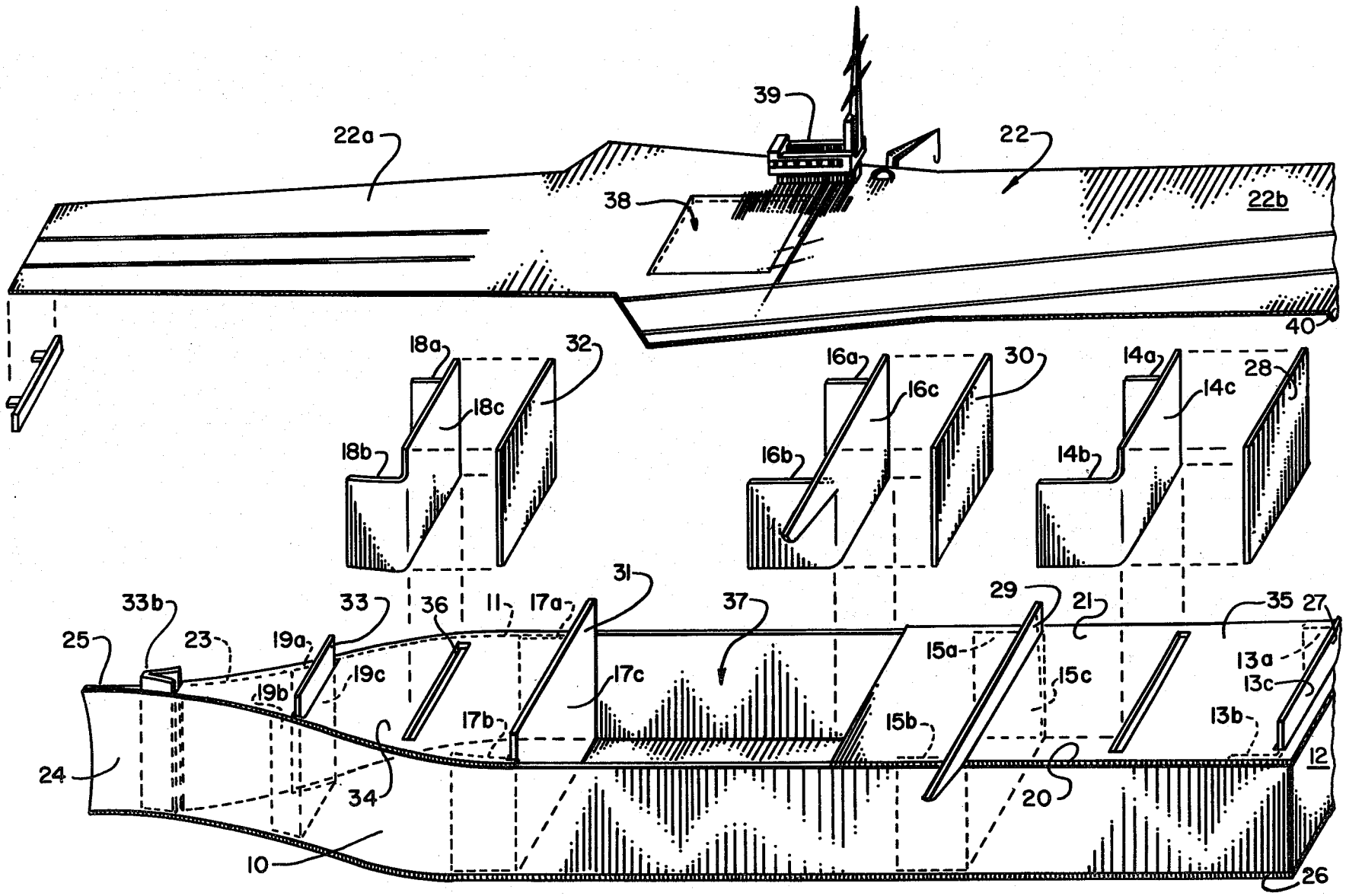
22b
40
28
14c
14a
14b
22
30
16c
16a
16b
39
38
32
18c
18a
18b
22a
27
35
13a
13c
13b
12
26
21
15c
20
29
15a
15b
37
31
17c
17a
11
17b
36
33
19c
34
19a
19b
10
23
33b
25
24

LARGE MODEL BOAT ASSEMBLY

BACKGROUND OF THE INVENTION

1. Field of the Invention

This invention relates to model boat building, and, more particularly, to the building of large model boats principally from cardboard and like material.

2. Prior Art

Model boats have previously been constructed from cardboard or like material, such as those described in U.S. Pat. No. 1,029,069 issued to S. L. Lazaron on June 11, 1912, and entitled "Combined Convertible Souvenir and Advertising Postal Card, Puzzle, Boat, and Box", U.S. Pat. No. 2,118,821 issued to W. A. Ringler on May 31, 1938, and entitled "Combined Merchandising Container and Toy", and U.S. Pat. No. 2,805,516 issued to Felix Palm on Sept. 10, 1957, and entitled "Milk Carton Convertible To A Toy". However, in each case, there was difficulty in achieving authenticity of the model.

In order to achieve authenticity and mass production of boat models, the industry has reverted to the use of plastic parts, although some very expensive models can still be purchased constructed from wood. However, because of cost, molding and structural difficulties, there is a practical limit to the size of present day boat models. For these reasons, plastic boat models in kit form longer than 48" are basically non-existent. Another difficulty with these prior art models is that they leak and generally cannot stay afloat for any period of time.

SUMMARY OF THE INVENTION

Therefore, it is an object of this invention to provide a boat model assembly that can be mass produced inexpensively.

Another object of this invention is to provide a boat model assembly constructed principally from cardboard and like material.

Still another object of this invention is to provide a principally cardboard boat model assembly that can be greater than 48" and still be mass produced inexpensively, yet be sturdily constructed and waterproofed.

Accordingly, a boat model assembly is provided comprising a braced cardboard hull, deck and superstructure wherein the braces are constructed from cardboard strips having foldable flexible end flaps that attach to the hull's interior wall surface.

BRIEF DESCRIPTION OF THE DRAWINGS

FIG. 1 is an exploded perspective view of an aircraft model boat assembly of this invention.

PREFERRED EMBODIMENTS OF THE INVENTION

Without any intention to limit the scope of this invention, the preferred embodiments will be described with specific reference to the construction of an aircraft carrier model boat assembly, and the embodiments can also be applied to the construction of battleships, missile crusiers, destroyers, etc.

Now referring to FIG. 1, ten- or twelve-ply cardboard hull sides 10 and 11 are glued together at their forward ends and then glued to stern side 12. Next, brace members 13, 14, 15, 16, 17, 18 and 19 are placed between and glued to hull sides 10 and 11 by their flap sections **13*a* and 13*b*, 14*a* and 14*b*, 15*a* and 15*b*, 16*a*** and

**16*b*, 17*a* and 17*b*, 18*a* and 18*b* and 19*a* and 19*b***, respectively.

Each brace member has a center section **13*c*, 14*c*, 15*c*, 16*c*, 17*c*, 18*c* and 19*c*, respectively, each of which extends between hull sides 10 and 11 to provide structural strength and basic shape to the hull. On either side of each center section are the flexible flap sections which bend from the center section and are flat so as to be glueable to one of the interior surfaces 20, 21 of hull sides 10, 11**, respectively. These flap sections act not only as the attaching means for the braces, but also provide additional structural strength to the hull sides to prevent distortion and handling damage.

In a preferred embodiment, a piece of balsa wood 23 is shaped and glued between hull sides 10, 11 at their bow ends 24, 25, respectively. This balsa wood 23 serves as a more rigid support and form at one of the most fragile areas of the aircraft carrier.

Once braces 14–19 have been attached, hull bottom 26 is glued into position as shown. In the case of the aircraft carrier design, flight deck supports, 27, 28, 29, 30, 31, 32, 33, 33A are next glued adjacent center sections **13*c*, 14*c*, 15*c*, 16*c*, 17*c*, 18*c* and 19*c*, respectively. Bow flight deck support 33A is a "V" shaped ten-ply cardboard member with "V" fitted into the "V" shape of the bow. Each flight deck support extends above hull sides 10, 11 about $\frac{3}{4}$ to 1 inch to form a support for flight deck 22. In a preferred feature, flight deck supports are constructed from corrugated cardboard. Next, the front lower deck 34 and rear lower deck 35 are glued into position as shown on hull sides 10, 11 so that the flight deck supports extend above lower decks. As indicated, lower decks 34, 35 are provided with slots 36 for the flight deck supports to pass. This arrangement adds additional structural strength to the hull. In a preferred feature, the lower decks are cut so as to form storage compartment 37**.

At this point, it is preferred that the hull and lower flight decks be painted and water sealed if desired. Next, flight deck 22 is glued to flight deck supports 27–33A. For shipping purposes, flight deck 22 can come in two pieces **22*a* and 22*b*. In a preferred feature, flight deck 22 will have a removable section 38 cut out directly above storage compartment 37. Next, add flap 40 at rear of flight deck 22B as shown wherein flap 40 has the same width of flight deck 22B and is $\frac{7}{8}$ inches wide. If desired, launching guides 41 made of balsa wood can be added to the front of flight deck 22. Also to increase the realism, a $\frac{1}{4}'' \times \frac{3}{4}''$ balsa wood strip 42 is hung in place the width of the front end of flight deck 22. Mapping tacks 43 can be put into this forward section of the deck to act as lights on front of carrier. Finally, the flight deck 22 is painted and radar and control tower 39** glued in position. Decals are then added to the superstructure after it is painted and act as windows and other items which add to realism of the superstructure. The above deck superstructure is then glued to flight deck where indicated.

The bottoms of all model ships are preferably constructed out of six-ply cardboard. The cardboard braces are preferably not glued to the bottom of the ship. Only the cardboard hull should be glued to the bottom of the ship.

The glue used for the entire construction is hot fuel proof extra fast drying cement. Model paint can be furnished with the model or purchased at a model or hobby shop. Actually, any type of quick drying paint of the color desired or specified can be used.

To waterproof the hull of any of these models, polyurethane water resistant varnish is suggested and can be furnished with the kit or be purchased at any paint store. The models do not have to be waterproofed if the builder wants the use of the model as a display item or to be used on dry floors and other dry surfaces.

As is seen, a sturdy model boat can be constructed principally from cardboard, then can be pre-cut and easily packaged for shippage. Also, with this invention, model boats in excess of 48" can be constructed.

There are, of course, many obvious alternate embodiments of this invention not specifically mentioned, but which are included within the scope of this invention defined in the following claims.

What I claim is:

1. A boat model assembly capable of floating in water comprising a braced cardboard hull assembly and a cardboard deck, said assembly comprising flat cardboard side walls attachable at their bow ends to each other and connected at their opposite ends by a flat cardboard stern wall, flat rectangular braces having flexible cardboard end flaps at each end of each brace, the braces extending between the side walls and attached thereto by glueing said flaps to the side walls, and a flat cardboard bottom attached to the side walls at their bottom ends.

* * * * *